United States Patent [19]

Nicol

[11] 4,132,680

[45] Jan. 2, 1979

[54] DETERGENT COMPOSITIONS HAVING SOIL RELEASE PROPERTIES

[75] Inventor: Charles H. Nicol, Hamilton, Ohio

[73] Assignee: The Procter & Gamble Company, Cincinnati, Ohio

[21] Appl. No.: 895,682

[22] Filed: Apr. 12, 1978

Related U.S. Application Data

[63] Continuation-in-part of Ser. No. 699,412, Jun. 24, 1976, abandoned, which is a continuation-in-part of Ser. No. 677,350, Apr. 15, 1976, abandoned, which is a continuation-in-part of Ser. No. 482,948, Jun. 25, 1974, abandoned.

[51] Int. Cl.[2] ..... C11D 3/30; C11D 3/37; D06M 15/10; D06M 15/38

[52] U.S. Cl. ..... 252/547; 8/137; 252/89 R; 252/133; 252/135; 252/524; 252/526; 252/528; 252/531; 252/532; 252/539; 252/542; 252/545; 252/558; 252/DIG. 1; 252/DIG.2; 252/DIG. 15; 427/390 E

[58] Field of Search ..... 8/137; 252/89, 133, 252/135, 526, 528, 531, 532, 539, 545, 547, 550, 551, 558, DIG. 1, DIG. 2, DIG. 15, 524, 542; 427/390 E

[56] References Cited

U.S. PATENT DOCUMENTS

| | | | |
|---|---|---|---|
| 2,766,212 | 10/1956 | Grifo | 252/551 |
| 2,908,651 | 10/1959 | Grifo | 252/153 |
| 3,416,952 | 12/1968 | McIntyre | 428/482 |
| 3,479,212 | 11/1969 | Robertson | 427/158 |
| 3,686,098 | 8/1972 | Weil | 252/550 |
| 3,712,873 | 1/1973 | Zenk | 260/29.2 E |
| 3,775,052 | 11/1973 | Van Paassen | 8/137 |
| 3,835,071 | 9/1974 | Allen | 252/545 |
| 3,869,399 | 3/1975 | Collins | 252/118 |
| 3,893,929 | 7/1975 | Basadur | 252/8.6 |
| 3,929,678 | 12/1975 | Laughlin | 252/526 |
| 3,959,230 | 5/1976 | Hays | 260/75 R |
| 3,962,152 | 6/1976 | Nicol et al. | 252/551 |
| 3,993,830 | 11/1976 | Dickson | 428/290 |
| 4,020,015 | 4/1977 | Bevan | 252/544 |

FOREIGN PATENT DOCUMENTS

| | | | |
|---|---|---|---|
| 2249812 | 4/1973 | Fed. Rep. of Germany | 252/89 |
| 2527793 | 1/1976 | Fed. Rep. of Germany | 252/89 |
| 1314897 | 4/1973 | United Kingdom | 252/89 |
| 1377092 | 12/1974 | United Kingdom | 252/89 |

*Primary Examiner*—Dennis L. Albrecht
*Attorney, Agent, or Firm*—Steven J. Goldstein; Robert B. Aylor; Richard C. Witte

[57] ABSTRACT

Detergent compositions, which are particularly suitable for providing hydrophobic fabrics, such as polyester, with a soil release effect for oily soils, are disclosed. These compositions contain surface-active agents, polyester soil release polymers, and a component which dissociates in aqueous solution producing quaternary ammonium cations. The process of laundering hydrophobic fibers in aqueous solutions of these compositions is also disclosed.

23 Claims, No Drawings

DETERGENT COMPOSITIONS HAVING SOIL RELEASE PROPERTIES

CROSS-REFERENCE TO RELATED APPLICATIONS

This application is a continuation-in-part of copending U.S. application Ser. No. 699,412, Nicol, filed June 24, 1976, now abandoned, which was a continuation-in-part of U.S. application Ser. No. 677,350, Nicol, filed Apr. 15, 1976, now abandoned, which was a continuation-in-part of U.S. application Ser. No. 482,948, filed June 25, 1974, now abandoned.

BACKGROUND OF THE INVENTION

The present invention relates to detergent compositions containing nonionic, anionic, zwitterionic, or ampholytic surface-active agents or mixtures thereof, a particularly defined soil release polymer comprising ethylene terephthalate and polyethylene oxide terephthalate in particular ratios and proportions, and a component which dissociates in aqueous solution producing quaternary ammonium cations. The detergent compositions herein clean and provide improved soil release benefits to synthetic fabrics, particularly polyester fabrics, when used in an aqueous laundering system. In addition, the detergent compositions herein permit the use of the disclosed soil release polymers in surfactant systems containing a broad range of surface-active agents.

Much effort has been expended in designing various compositions capable of conferring soil release properties to fabrics woven from polyester fibers. These fabrics are mostly copolymers of ethylene glycol and terephthalic acid, and are sold under a number of trade names, for example, Dacron, Fortrel, Kodel and Blue C Polyester. The hydrophobic character of polyester fabrics makes their laundering, particularly as regards oily soils and oily stains, difficult, principally due to the inherently low wettability of the polyester fibers. Since the character of the fiber itself is hydrophobic, or oleophilic, once an oily soil or oily stain is deposited on the fabric, it becomes bound to the surface of the fiber. As a result, the oily soil or stain is difficult to remove in an aqueous laundering process.

When hydrophilic fabrics, such as cotton, are soiled by an oily stain or soil, it is well recognized that the oil is much more easily removed than in the case of hydrophobic polyester fabrics. This difference in oil removal characteristics is apparently caused by a greater affinity of cotton fabrics for water and surfactant. The differing hydrophilic/hydrophobic characteristics of cotton and polyester are due in part to the basic building blocks of the fibers themselves. That is, since polyester fibers are copolymers of terephthalic acid and ethylene glycol, they have less affinity for water because there are fewer free hydrophilic groups, e.g., hydroxyl or carboxyl groups, where hydrogen bonding can occur. With cotton, which is a cellulose material, the large number of hydrophilic groups provides compatability with, and affinity for, water.

In terms of detergency, the most important difference between hydrophobic fabrics and hydrophilic fabrics is the tendency for oily soils to form easily removable droplets when present on a hydrophilic fabric and in contact with water and surfactant. The mechanical action of washing and the action of synthetic detergents and builders normally used in the washing step of the laundering process removes such oily droplets from the fabric. This droplet formation is in contrast to the situation which exists with a polyester (hydrophobic) fiber. Water does not "wick" well through hydrophobic fabrics and the oily soil or stain tends to be retained throughout the fabric, both because of the inherent hydrophobic character of the fabric and the lack of affinity of oily soils for water.

Since polyester and polyester blend fabrics, such as polyester/cotton blends, are susceptible to oily staining, and, once stained, are difficult to clean in an aqueous laundry bath, manufacturers of polyester fibers and fabrics have sought to increase the hydrophilic character of the polyester to provide ease of laundering.

A number of approaches to the problem of increasing the hydrophilic character of polyester fabrics and fabric blends have been taken. Many of these approaches involve a process employed by the textile fiber manufacturer or the textile manufacturer. For example, U.S. Pat. No. 3,712,873, Zenk, issued Jan. 23, 1973, discloses the use of polyester polymers in combination with single long chain quaternary ammonium salts as fabric treating compositions. This reference teaches that di- and tri-long chain quaternary ammonium materials should be avoided in formulating such compositions. Terpolymers having a molecular weight in the range from 1,000 to 100,000 and a molar ratio of terephthalic acid: polyglycol:glycol from 4.5:3.5:1 are disclosed. These compositions are designed to be applied directly by spraying or padding onto textiles containing polyester or polyamide synthetic textile materials for the purpose of improving the soil release characteristics of these materials.

U.S. Pat. No. 3,959,230, to Hays, issued May 25, 1976, teaches that the soil release properties of polyester-containing fabrics may be improved by treating those fabrics with dilute aqueous solutions of ethylene terephthalate/polyethylene oxide terephthalate copolymers having a molar ratio of ethylene terephthalate to polyethylene oxide terephthalate of from about 25:75 to about 35:65, the polyethylene oxide having a molecular weight of from about 300 to 700 and the molecular weight of the entire polymer being in the range of from about 25,000 to about 55,000. U.S. Pat. No. 3,479,212, Robertson et al, issued Nov. 18, 1969, and U.S. Pat. No. 3,416,952, McIntyre et al., issued Dec. 17, 1968, disclose the use of ethylene terephthalate/polyethylene oxide terephthalate copolymers in the manufacture of polyester articles to provide them with enhanced hydrophilic character, and hence enhanced oily soil removal effect.

It has also been suggested that soil release polymers may be incorporated into detergent compositions so that when polyester-containing fabrics are washed in laundry solutions containing these detergent compositions, the fabrics are modified in such a way that oil-containing stains subsequently formed on the fabric are more easily removed on subsequent washing. Even if the fabrics are treated by the manufacturer, as in the processes described above, the treatment benefit is diminished as the fabrics age, mainly due to removal of the soil release polymer through washing in ordinary detergent products. Thus, the use of detergent compositions containing soil release polymers provide fabrics washed in them with an ongoing soil release benefit.

British patent specification No. 1,377,092, Bevan et al, published Dec. 11, 1974, teaches the use of polyoxyethylene glycol/polyethylene terephthalate copolymers as soil-release agents in detergent compositions containing nonionic surfactants. It is indicated that the presence of anionic surfactants in the detergent compositions should be avoided, since such surfactants would decrease the soil-release properties of the compositions. Builders may be included in the compositions disclosed in the British patent. There is, however, no indication that the presence of specific cations will have any effect on the soil-release performance of the copolymer-containing detergent compositions.

South African patent specification No. 72/7174, Bevan, discloses a process by which a terephthalate copolymer or cellulose ether soil-release agent is dispersed in a granule for use in a granular laundry detergent composition.

U.S. Pat. No. 3,962,152, to Nicol et al, issued June 8, 1976, teaches the use of specific ethylene terephthalate/ethylene oxide terephthalate copolymers in solid dry detergent compositions.

Although the use of terephthalate/ethylene oxide terephthalate copolymers as soil-release agents in detergent compositions has been disclosed in the art, there has been no recognition of the fact that the presence of specific quaternary ammonium cations in the aqueous laundry solution of the detergent compositions has any effect on the deposition of the polymers from the solution or on the soil-release performance of the polymer-containing compositions. It has now been found that by introducing the specific quaternary ammonium cations defined herein, into the aqueous laundry solution of detergent compositions containing specific terephthalate copolymer soil-release agents, these detergent compositions will provide increased deposition of the polymer from the solution onto the fabric and, hence, superior removal of oily soils and stains.

It is, thus, a primary object of this invention to provide detergent compositions which exhibit excellent cleaning performance while concurrently imparting soil-release properties to hydrophobic fabrics washed therewith.

It is another object of this invention to provide detergent compositions comprising nonionic, anionic, zwitterionic, and ampholytic surfactants in combination with polymeric soil-release ingredients.

It is a further object of this invention to provide detergent compositions comprising soil-release polymers having specific molar ratios of ethylene terephthalate to polyethylene oxide terephthalate.

It is a further object of this invention to provide a method for the improved removal of oily soils from hydrophobic fibers.

The above and other objects are accomplished by formulating detergent compositions containing water-soluble surfactants and polymers composed of terephthalate esters, as described hereinafter.

SUMMARY OF THE INVENTION

The present invention encompasses laundry detergent compositions capable of simultaneously cleaning and imparting improved soil-release characteristics to fabrics, especially hydrophobic fabrics, such as polyesters. The compositions herein comprise:

(a) from about 2% to about 95% by weight of a surfactant selected from the group consisting of water-soluble anionic, nonionic, zwitterionic, and ampholytic surface-active agents and mixtures thereof; and (b) from about 0.15% to about 25% by weight of a polymer comprising ethylene terephthalate and polyethylene oxide terephthalate at a molar ratio of ethylene terephthalate to polyethylene oxide terephthalate of from about 65:35 to about 80:20, said polyethylene oxide terephthalate containing polyethylene oxide linking units having a molecular weight of from about 1,000 to about 3,000, the molecular weight of said soil release polymer being in the range of from about 10,000 to about 50,000;

wherein at least about 15% of said detergent composition is comprised of surfactant and detergency builder components, and wherein from about 0.05% to about 15.0% of said composition dissociates, in aqueous solution, yielding quaternary ammonium cations which include at least one, and not more than three, chains each containing from 8 to 24 carbon atoms.

The compositions herein may also contain various optional adjunct materials commonly employed in detergent compositions.

A method for the improved removal of oily soils and stains from hydrophobic fibers, utilizing the disclosed detergent compositions, is also disclosed.

DETAILED DESCRIPTION OF THE INVENTION

The detergent compositions of the instant invention comprise:

(1) a water-soluble surfactant or mixtures thereof;

(2) a specific type of soil release polymer; and (3) a component which provides specific quaternary ammonium cations in the aqueous laundry solution of the detergent composition.

These components are described in detail hereinafter.

Unless stated otherwise, percentages and ratios are by weight, and temperatures are in Centigrade.

Surfactant Component

Detergent compositions of the present invention comprise from about 2% to 95% by weight of a surfactant selected from anionic, nonionic, ampholytic, and zwitterionic surfactants. Such compositions preferably contain from about 10% to 60% by weight of surfactant. Surfactant levels tend to be relatively high, from 20% to 60%, in liquid compositions and relatively low, from 10% to 25% in granular compositions. Pasty or gel-like compositions may have very much higher surfactant concentrations, for example, from 45% to 95%. Liquid compositions which are designed for use without dilution may have from 2% to 10% of surfactant.

A total of at least about 15, preferably at least about 20%, by weight of the compositions of the present invention must comprise surface-active agent and detergency builder materials in order to assure proper cleaning performance in the laundering process.

Water-soluble surfactants used in the presoaking-/washing compositions herein include any of the common anionic, nonionic, ampholytic and zwitterionic detersive surfactants well known in the detergency arts. Mixtures of surfactants can also be employed herein. More particularly, the surfactants listed in U.S. Pat. No. 3,717,630, Booth, issued Feb. 20, 1973 and Kessler et al, U.S. Pat. No. 3,332,880, issued July 25, 1967, each incorporated herein by reference, can be used herein. Non-limiting examples of surfactants suitable for use in the instant compositions are as follows:

Water-soluble salts of the higher fatty acids, i.e., "soaps", are useful as the anionic surfactant herein. This class of surfactants includes ordinary alkali metal soaps such as the sodium, potassium, ammonium, and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactants includes water-soluble salts, particularly the alkali metal, ammonium and alkanolammonium salts, of organic sulfuric reaction products having in their molecular structure an alkyl group containing from about 8 to about 22 carbon atoms and a sulfonic acid or sulfuric acid ester group. (Included in the term "alkyl" is the alkyl portion of acyl groups.) Examples of this group of synthetic surfactants which can be used in the present laundering compositions are the sodium and potassium alkyl sulfates, especially those obtained by sulfating the higher alcohols ($C_8$–$C_{18}$ carbon atoms) produced by reducing the glycerides of tallow or coconut oil; and sodium and potassium alkyl benzene sulfonates, in which the alkyl group contains from about 9 to about 15 carbon atoms in straight chain or branched chain configuration, e.g., those of the type described in U.S. Pat. Nos. 2,220,099, and 2,477,383, incorporated herein by reference.

Other anionic surfactant compounds useful herein include the sodium alkyl glyceryl ether sulfonates, especially those ethers or higher alcohols derived from tallow and coconut oil; sodium coconut oil fatty acid monoglyceride sulfonates and sulfates; and sodium or potassium salts of alkyl phenol polyethylene oxide ether sulfate containing about 1 to about 10 units of ethylene oxide per molecule and wherein the alkyl groups contain about 8 to about 12 carbon atoms.

The alkaline earth metal salts of synthetic anionic surfactants are useful in the present invention. In particular, the magnesium salts of linear alkylbenzene sulfonates, in which the alkyl group contains from 9 to about 15, especially 11 to 13, carbon atoms, are useful. A preferred surfactant is magnesium neutralized $C_{11}$–$C_{13}$ linear alkylbenzene sulfonate.

Other useful anionic surfactants herein include the water-soluble salts of esters of $\alpha$-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble anionic organic surfactants herein include linear and branched chain alkyl benzene sulfonates containing from about 10 to 16 carbon atoms in the alkyl group; alkyl sulfates containing from about 10 to 16 carbon atoms; the coconut range alkyl glyceryl sulfonates; and alkyl ether sulfates wherein the alkyl moiety contains from about 10 to 16 carbon atoms and wherein the average degree of ethoxylation varies between 1 and 6.

Specific preferred anionic surfactants for use herein include: sodium linear $C_{10}$–$C_{12}$ alkyl benzene sulfonate; triethanolamine $C_{10}$–$C_{12}$ alkyl benzene sulfonate; sodium tallow alkyl sulfate; sodium coconut alkyl glyceryl ether sulfonate; and the sodium salt of a sulfated condensation product of tallow alcohol with from about 3 to about 10 moles of ethylene oxide.

It is to be recognized that any of the foregoing anionic surfactants can be used separately herein or as mixtures.

Most commonly, nonionic surfactants are compounds produced by the condensation of an alkylene oxide, especially ethylene oxide (hydrophilic in nature) with an organic hydrophobic compound, which is usually aliphatic or alkyl aromatic in nature. The length of the hydrophilic polyoxyalkylene moiety which is condensed with any particular hydrophobic compound can be readily adjusted to yield a water-soluble compound having the desired degree of balance between hydrophilic and hydrophobic properties. Examples of suitable nonionic surfactants herein include:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, said ethylene oxide being present in an amount equal to 5 to 25 moles of ethylene oxide per mole of alkyl phenol. The alkyl substituent in such compounds can be derived, for example, from polymerized propylene, diisobutylene, and the like. Examples of compounds of this type include nonyl phenol condensed with about 9.5 moles of ethylene oxide per mole of nonyl phenol; dodecyl phenol condensed with about 12 moles of ethylene oxide per mole of phenol; dinonyl phenol condensed with about 15 moles of ethylene oxide per mole of phenol; and di-isooctylphenol condensed with about 15 moles of ethylene oxide per mole of phenol. Commercially available nonionic surfactants of this type include Igepal CO-630 marketed by the GAF Corporation; and Triton X-45, X-114, X-100 and X-102, all marketed by the Rohm and Haas Company.

(2) The condensation products of aliphatic alcohols with from about 2 to about 16 moles of ethylene oxide. The alkyl chain of the aliphatic alcohol can be either straight or branched and generally contains from about 8 to about 22 carbon atoms. Examples of such ethoxylated alcohols include the condensation product of about 6 moles of ethylene oxide with 1 mole of tridecanol; myristyl alcohol condensed with about 10 moles of ethylene oxide per mole of myristyl alcohol; the condensation product of ethylene oxide with coconut fatty alcohol wherein the coconut alcohol is a mixture of fatty alcohols with alkyl chains varying from 10 to 14 carbon atoms in length and wherein the condensate contains about 5 moles of ethylene oxide per mole of alcohol; the condensation product of $C_{14-15}$ alcohol with 4 moles of ethylene oxide; the condensation product of $C_{12}$ alcohol with 5 moles of ethylene oxide; the condensation product of $C_{10}$ alcohol with 4 moles of ethylene oxide; the condensation product of $C_{14}$ alcohol with 6 moles of ethylene oxide; the condensation product of $C_{12}$ alcohol with 4 moles of ethylene oxide; the condensation product of $C_{12-15}$ alcohol with 7 moles of ethylene oxide; the condensation product of $C_{12-13}$ alcohol with 3 moles of ethylene oxide, and the same condensation product which is stripped to remove lower ethoxylate and nonethoxylated compounds; the condensation product of $C_{14-15}$ alcohol with 7 moles of ethylene oxide; the condensation product of $C_{12-13}$ alcohol with 6.5 moles of ethylene oxide; the condensation product of secondary $C_{15}$ alcohol with 5 moles of ethylene oxide; and the condensation product of about 9 moles of ethylene oxide with the above-described coconut alcohol. Examples of commercially available nonionic surfactants of this type include Tergitol 15-S-9 marketed by Union Carbide Corporation, Neodol 23-6.5 marketed by Shell Chemical Company and Kyro EOB marketed by The Procter & Gamble Company.

(3) The condensation products of ethylene oxide with a hydrophobic base formed by the condensation of propylene oxide with propylene glycol. The hydrophobic portion of these compounds has a molecular weight of from about 1500 to 1800 and, of course, exhibits water insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product. Examples of compounds of this type include certain of the commercially available Pluronic surfactants marketed by Wyandotte Chemicals Corporation.

(4) The condensation products of ethylene oxide with the product resulting from the reaction of propylene oxide and ethylene diamine. The hydrophobic moiety of these products consists of the reaction product of ethylene diamine and excess propylene oxide, said moiety having a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by Wyandotte Chemicals Corporation.

Nonionic surfactants may also be of the semi-polar type including water-soluble amine oxides containing one alkyl moiety of from about 10 to 28 carbon atoms and 2 moieties selected from the group consisting of alkyl groups and hydroxyalkyl groups containing from 1 to about 3 carbon atoms; water-soluble phosphine oxides containing one alkyl moiety of about 10 to 28 carbon atoms and 2 moieties selected from the group consisting of alkyl groups and hydroxyalkyl groups containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

In the detergent compositions of the instant invention it is preferred that the particular nonionic surfactants employed have a hydrophilic-lipophilic balance (HLB) of from about 8 to about 15. Highly preferred nonionic surfactants are the condensation products of at least 5 moles of ethylene oxide with a $C_{10}$–$C_{16}$ aliphatic alcohol.

Another preferred nonionic surfactant herein comprises a mixture of "surfactant" and "co-surfactant" as described in the application of Collins, Ser. No. 406,413, filed Oct. 15, 1973, the disclosures of which are incorporated herein by reference. The term "nonionic surfactant" as employed herein encompasses these preferred mixtures of Collins.

Particularly preferred surfactant systems for use in the present invention include mixtures of nonionic and anionic surfactants, wherein the mixture contains at least 5%, by weight, of nonionic surfactant.

Ampholytic surfactants include derivatives of aliphatic heterocyclic secondary and tertiary amines in which the aliphatic moiety can be straight chain or branched and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium, phosphonium, and sulfonium compounds in which the aliphatic moieties can be straight or branched chain, and wherein one of the aliphatic substituents contains from about 8 to 18 carbon atoms and one contains an anionic water-solubilizing group. Particularly preferred zwitterionic materials are the ethoxylated ammonium sulfonates and sulfates disclosed in U.S. Pat. No. 3,925,262, Laughlin et al., issued Dec. 9, 1975, U.S. Pat. 3,929,678, Laughlin et al., issued Dec. 30, 1975 and U.S. patent application Ser. No. 603,837, Laughlin et al., filed Aug. 11, 1975, all of which are incorporated herein by reference. The inclusion of these surfactants in the compositions of the present invention provides detergent compositions which give excellent clay soil and oily stain removal performance on polyester fabrics.

Particularly preferred ethoxylated zwitterionic surfactants are those having the formulae:

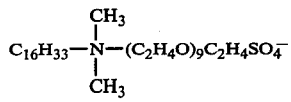

(hereinafter referred to as $C_{16}N(EO)_9SO_4$) and

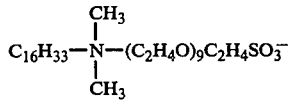

(hereinafter referred to as $C_{16}N(EO)_9SO_3$)

Additional preferred zwitterionic surfactants include those having the formula

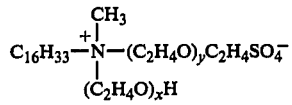

wherein the sum of x + y is equal to about 15.

Soil Release Polymer

As a further essential ingredient, the compositions of the instant invention contain from about 0.15% to about 25% preferably from about 0.5% to about 15%, more preferably from about 1% to about 10%, of a soil release polymer containing ethylene terephthalate groups having the formula:

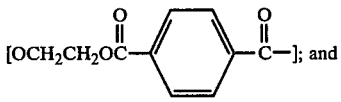

polyethylene oxide terephthalate groups having the formula:

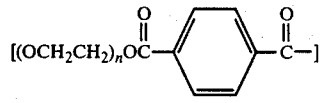

wherein the molar ratio of ethylene terephthalate to polyethylene oxide terephthalate in the polymer is from about 20:80 to about 90:10. The molecular weight of the polyethylene oxide linking unit is in the range from about 300 to about 10,000, i.e., n in the above formula is an integer of from about 7 to about 220. The polymers have an average molecular weight in the range from about 5,000 to about 200,000. The polymers are also characterized by a random polymer structure, i.e., all possible combinations of ethylene terephthalate and polyethylene oxide terephthalate can be present.

Preferred polymers have an ethylene terephthalate/-polyethylene oxide terephthalate molar ratio of from about 50:50 to about 90:10, containing polyethylene oxide linking units having a molecular weight of from about 1,000 to about 3,000. Particularly preferred polymers have an ethylene terephthalate/polyethylene oxide terephthalate molar ratio of from about 65:35 to about 80:20, containing polyethylene oxide linking units having a molecular weight of from about 1,000 to about 3,000, with a polymer molecular weight of from about 10,000 to about 50,000. An example of a commercially available polymer of this type is available from ICI United States, Inc., sold under the trademark Milease T, as described in ICI Technical Bulletin 431R.

Examples of the polymers which may be utilized in the present invention appear in Table I, with Polymer A and F being preferred.

TABLE I

| | A | B | C | D | E | F |
|---|---|---|---|---|---|---|
| Moles of ethylene terephthalate (ET) | 70 | 50 | 70 | 90 | 30 | 80 |
| Moles of ethylene oxide terephthalate (EOT) | 30 | 50 | 30 | 10 | 70 | 20 |
| Molecular weight of ethylene oxide in EOT | 1496 | 1144 | 704 | 4400 | 600 | 1000 |
| Molecular weight of polymer | 20,000 | 50,000 | 40,000 | 100,000 | 40,000 | 40,000 |

The soil release polymers herein are substantive to hydrophobic fabrics, particularly polyesters, under laundry conditions, apparently because of the presence of the hydrophobic ethylene oxide terephthalate groups.

The soil-release polymers used in this invention can be prepared by conventional polymerization processes known in the art, using only those molar ratios of precursor materials which provide the critical ratios of ethylene terephthalate:polyethylene oxide terephthalate set forth above. As an example, the processes described in the specification of U.S. Pat. No. 3,479,212, Robertson et al., issued Nov. 18, 1969, can be used for preparing operable polymers herein by selecting the proper monomer precursors. A preferred group of polymers for use herein is prepared according to the following technique: 194 g. dimethyl terephthalate, 155 g. ethylene glycol, 420 g. polyethylene oxide (molecular weight 1540); 0.44 g. 2,6-di-tert-butyl-4-methylphenol; 0.0388 g. antimony trioxide; and 0.1512 g. calcium acetate are mixed in a suitable reaction vessel and heated from 194° C. to 234° C. with stirring over a 4.5 hour period. During this time, methanol is distilled from the reaction vessel. Following addition of 0.141 g. of a 24.8% solution of phosphorous acid in ethylene glycol to the foregoing reaction mixture, the molten mixture is transferred to a polymerization tube heated to 282° C. After the excess glycol has been blown off in a rapid stream of nitrogen the pressure is reduced to 0.1 mm of mercury and polymerization is continued for 15 minutes. Dispersions of the polymer prepared in this manner can be made by mixing the molten polymer with water in a Waring blender.

Cation-Producing Component

The detergent compositions of the present invention contain from about 0.05% to about 15.0%, preferably from about 0.05% to about 10.0%, and most preferably from about 0.1% to about 5.0%, of a component which dissociates in aqueous solution yielding quaternary ammonium cations which include at least one, and no more than three, long carbon chains each containing from 8 to 24, preferably from 10 to 20, carbon atoms. It is preferred that these long carbon chains be attached directly to the quaternary nitrogen atom. The remaining groups attached to the quaternary nitrogen are preferably $C_1$ to $C_3$ alkyl or hydroxyalkyl groups. Thus, a preferred group of cations have the formula

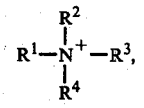

wherein at least one, and preferably two or three of the $R^1$, $R^2$ and $R^3$ groups each contain from 8 to 24 carbon atoms, and the remaining R groups are $C_1$ to $C_3$ alkyl or hydroxyalkyl groups.

Although it is preferred that the long chains be alkyl groups, these chains may contain hetero atoms and other linkages, such as hydroxy groups, double or triple carbon-carbon bonds, and ester, amide, or ether linkages, as long as each chain falls within the carbon atom ranges, given above. Preferred mono-long chain cations include tallowalkyltrimethylammonium cations, stearylalkyltrimethylammonium cations, palmitylalkyltrimethylammonium cations, coconutalkyltrimethylammonium cations, hexadecylalkyltrimethylammonium cations, octadecylalkyltrimethyl ammonium cations, and dodecylalkyltrimethylammonium cations. Preferred di-long chain cations include ditallowalkyldimethyl ammonium cations, dicoconutalkyldimethylammonium cations, distearylalkyldimethylammonium cations, didodecylalkyldimethylammonium cations, dihexadecylalkyldimethylammonium cations, and diocatadecylalkyldimethylammonium chloride. Preferred tri-long chain cations include trioctylalkylmethylammonium cations and tridecylalkylmethylammonium cations.

Another preferred type of cation useful in the present invention is of the mono-, di-, and tri-long chain imidazolinium variety. A particularly preferred di-long chain cation of this type has the structural formula

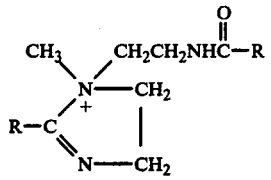

wherein each R is a $C_{10}$ to $C_{20}$ alkyl, particularly $C_{14}$ to $C_{20}$ alkyl.

While not intending to be bound by theory, it is believed that the terephthalate soil release polymer assumes some degree of anionic character when it is placed in solution, as in the laundering process. The association of the polymer with the cations in the laundry solution improves the deposition of the polymer onto the fabric being laundered and, thus, improved removal of oil and grease results. The quaternary ammonium cations, defined herein, have a higher degree of affinity for the anionic polymer molecules are, therefore, preferred for use in the compositions of the present invention.

These cations are introduced into the laundry solution by including in the detergent compositions of the present invention a component which dissociates, in solution, yielding the desired cations. These cations may be introduced as the counter-ions of anionic surfactants used in the compositions, but are preferably included in the detergent compositions of the present invention separately from the surfactant component. Examples of the latter compounds include the chloride, bromide, iodide, and methyl sulfate salts of the preferred ammonium cations, given above. Additional examples of quaternary ammonium compounds useful in the present invention are described in U.S. Pat. No. 3,360,470 and U.S. Pat. No. 3,591,405, both of which are incorporated herein by reference.

The compositions of the present invention may also contain detergency builders, at their art-established levels, to control the level of free hardness ions in the laundry solution. The presence of detergency builders in the detergent compositions of the present invention will serve to maintain the pH of laundry solutions containing the present compositions in the range of from about 7 to about 12, preferably from about 7 to about 10. The builders also enhance fabric cleaning performance and suspend particulate soils released from the surface of the fabric. Preferred compositions of the present invention may contain from 0% to about 50% builder.

Detergency builders useful herein can be of the polyvalent inorganic and polyvalent organic types, or mixtures thereof. Nonlimiting examples of suitable water-soluble inorganic alkaline detergent builder salts include the alkali metal carbonates, borates, phosphates, polyphosphates, tripolyphosphates, bicarbonates, silicates, and sulfates. Specific examples of such salts include the sodium and potassium tetraborates, perborates, bicarbonates, carbonates, tripolyphosphates, orthophosphates, and hexametaphosphates.

Examples of suitable organic alkaline detergency builder salts are (1) water-soluble aminopolyacetates, e.g., sodium and potassium ethylene diamine tetraacetates, nitrilotriacetates, and N-(2-hydroxyethyl)nitrilodiacetates; (2) water-soluble salts of phytic acid, e.g., sodium and potassium phytates; (3) water-soluble polyphosphonates, including sodium, potassium, and lithium salts of ethane-1-hydroxy-1,1-diphosphonic acid; (4) sodium, potassium, and lithium salts of methylene diphosphonic acid and the like.

Additional organic builder salts useful herein include the polycarboxylate material described in U.S. Pat. No. 2,264,103, including the water-soluble alkali metal salts of mellitic acid. The water-soluble salts of polycarboxylate polymers and copolymers such as are described in U.S. Pat. No. 3,308,067, incorporated herein by reference, are also suitable for use herein. It is to be understood that while the alkali metal salts of the foregoing inorganic and organic polyvalent anionic builder salts are preferred for use herein from an economic standpoint, the ammonium, alkanolammonium, e.g., triethanolammonium, diethanolammonium, and the like, water-soluble salts of any of the foregoing builder anions are also useful herein.

Mixtures of organic and/or inorganic builders can be used herein. One such mixture of builders is disclosed in Canadian Pat. No. 755,038, e.g., a ternary mixture of sodium tripolyphosphate, trisodium nitrilotriacetate, and trisodium ethane-1-hydroxy-1,1-diphosphonate.

A further class of builder salts is the insoluble aluminosilicate type which functions by cation exchange to remove polyvalent mineral hardness and heavy metal ions from solution. A preferred builder of this type has the formulation $Na_z[(AlO_2)_z(SiO_2)_y]\cdot xH_2O$, wherein z and y are integers of at least 6, the molar ratio of z to y is in the range of from 1.0 to about 0.5, and x is an integer from about 10 to about 264. Compositions incorporating builder salts of this type are taught in commonly assigned application of John Michael Corkill, Bryan L. Madison, and Michael E. Burns, Ser. No. 450,266, filed Mar. 11, 1974, and entitled "Detergent", the disclosure of which is incorporated herein by reference.

Calcium-specific builders, i.e., those builders having a much greater affinity for calcium ions than magnesium ions, are preferred for use in the compositions of the present invention. Examples of such calcium-specific builders include sodium carbonate, 2-oxy-1,1,3-propane tricarboxylate and certain aluminosilicate builders.

Another type of detergency builder material useful in the present compositions and processes comprises a water-soluble material capable of forming a water-insoluble reaction product with water hardness cations in combination with a crystallization seed which is capable of providing growth sites for said reaction product. Such "seeded builder" compositions are fully disclosed in the application of Benjamin, Ser. No. 486,297, filed July 8, 1974, the disclosures of which are incorporated herein by reference.

Other preferred builder materials include sodium tripolyphosphate, sodium carbonate, and 2-oxy-1,1,3-propane tricarboxylate.

The compositions of the present invention may also be completely unbuilt, containing no detergency builder material in them. A preferred embodiment of the present invention is an unbuilt detergent composition containing calcium or magnesium neutralized anionic surfactants.

In addition to the ingredients described hereinbefore, other optional nonessential and noninterfering components, in amounts of from about 0.5% to about 40%, may be added to the instant compositions to provide improved performance or aesthetic appeal. Such ingredients may include, but are not limited to, bleach compounds, suds regulating agents such as suds boosters and suds suppressing agents, tarnish inhibitors, soil suspending agents, buffering agents, enzymes, enzyme stabilizing agents, brighteners, fluorescers, dyes, perfumes, inert carriers, and mixtures thereof.

The detergent compositions of the present invention may be formulated by preparing each component separately and thoroughly mixing them together in any order. Further, they may be prepared as liquid detergent compositions, the term "liquid" encompassing semi-liquid or gel compositions as well as more conventional free-flowing formulations, or as substantially dry powders, dry powder admixes, or spray-dried granules in the manner well known in the detergency art.

In its method aspect, this invention encompasses the laundering of fabrics in aqueous solutions containing from about 0.01 to about 0.3%, preferably from about 0.02 to about 0.2%, most preferably 0.03 to about 0.15%, of the disclosed detergent compositions, to achieve improved release of greasy and oily soils on subsequent launderings.

The following examples are illustrative of this invention, but are not intended to be limiting thereof.

EXAMPLE I

The following procedure was used to test the soil-release and cleaning characteristics of the detergent compositions of the present invention. Two 5" square swatches of polyester fabric were washed once in one liter of an aqueous solution of a detergent composition (about 1500 ppm) containing soil release polymer A and a cation-producing component (Pretreatment). This washing was done using a tergotometer for a ten minute period at 100 rpm agitation, in 40° C. water of 2 grains/-gallon hardness, having a 3:1 ratio of calcium to magnesium hardness ions. The fabric was then rinsed thoroughly and machine dried. The swatches were then stained with dirty motor oil, were allowed to age for 2.5 hours, and were then washed in the detergent composition given below. A Gardner color difference meter (Gardner Labs Inc.) was used to obtain the relfectance (L-value) of the stained area before washing ($L_{before}$), after washing ($L_{after}$), and from the clean swatch ($L_{clean}$). The percent stain removal was then determined using the formula:

$$\% \text{ Removal} = \frac{L_{after} - L_{before}}{L_{clean} - L_{before}} \times 100$$

| Component | Weight % |
|---|---|
| Sodium $C_{11.8}$ linear alkylbenzene sulfonate | 7.0 |
| Sodium tallow alkyl sulfate | 5.5 |
| Sodium salt of sulfated tallow alcohol ethoxylated with 3 moles of ethylene oxide | 5.5 |
| Sodium pyrophosphate | 11.7 |
| Zeolite A | 15.0 |
| Sodium sulfate | 38.5 |
| Polyethylene glycol 6000 | 0.9 |
| Sodium silicate (2.4r) | 8.0 |
| Sodium polymetaphosphate $(NaPO_3)_{21}$ | 0.9 |
| Moisture and minors | Balance |

The pretreatment detergent compositions, having the above active system and containing soil release polymer A together with various cation-producing components, were made up such that each pretreatment solution contained about 20 ppm of the soil-release polymer/cation-producing component combination. The various components used and the percent removal results for each cation-producing component are summarized below.

| Solution | Cation-Producing Component | Molar Ratio Component: Polymer | % Removal |
|---|---|---|---|
| A | — | — | 34 |
| B | — | — | 32 |
| C | LiCl | 1:2 | 76 |
| D | ZnO | 1:2 | 68 |
| E | $ZnCl_2$ | 1:2 | 74 |
| F | Triethanolamine | 1:2 | 67 |
| G | Ditallowalkyldimethylammonium chloride | 1:4 | 88 |

The results demonstrate the improved soil released benefits for oily soils which resulted when the compositions contained a component which yielded quaternary ammonium cations in the laundry solution.

Comparable results are obtained when the cation-producing component used is coconutalkyltrimethylammonium bromide, hexadecylalkyltrimethylammonium iodide, stearylalkyl trimethylammonium chloride, dicoconutalkyldimethylammonium chloride, dioctadecylalkyldimethylammonium methyl sulfate, dihexadecylalkyldimethylammonium chloride, distearylalkyldimethylammonium chloride, trioctylalkylmethylammonium methyl sulfate, tridecylalkylmethylammonium chloride, or methyl (1) tallowalkyl amido ethyl (2) tallowalkyl imidazolinium methyl sulfate.

Comparable results are also obtained when the anionic surface-active agents contained in the pretreatment composition are replaced by other linear or branched chain alkylbenzene sulfonates containing from about 10 to about 16 carbon atoms in the alkyl group; alkyl sulfates containing from about 10 to 16 carbon atoms; the coconut range alkyl glyceryl sulfonates; and alkyl ether sulfates wherein the alkyl moiety contains from about 10 to 16 carbon atoms and wherein the average degree of ethoxylation varies between 1 and 6.

Similar results are also obtained when the detergency builder components of the pretreatment composition are replaced by sodium or potassium tetraborate, perborate, bicarbonate, carbonate, tripolyphosphate, orthophosphate, hexametaphosphate, or 2-oxy-1,1,3-propane tricarboxylate.

EXAMPLE II

A granular built laundry detergent composition, having the following formula, is prepared in a conventional manner.

| Component | Weight % |
|---|---|
| Sodium $C_{11.8}$ linear alkylbenzene sulfonate | 8.0 |
| Sodium tallow alkyl sulfate | 9.0 |
| Sodium tripolyphosphate | 24.4 |
| Sodium sulfate | 37.5 |
| Sodium silicate (2.4r) | 12.0 |
| Soil release polymer A | 1.7 |
| Ditallowalkyldimethylammonium chloride | 2.0 |
| Moisture and minors | Balance to 100 |

The foregoing composition provides excellent cleaning and soil-release characteristics to hydrophobic fabrics which are washed in an aqueous solution of it.

EXAMPLE III

A granular built laundry detergent composition, having the following formula, is prepared in a conventional manner:

| Component | Weight % |
|---|---|
| Sodium $C_{11.8}$ linear alkylbenzene sulfonate | 13.5 |
| Condensation product of $C_{14-15}$ alcohol with 7 moles of ethylene oxide (Neodol 45-7) | 4.5 |
| Sodium tripolyphosphate | 24.4 |
| Sodium sulfate | 36.5 |
| Sodium silicate (2.4r) | 12.0 |
| Soil release polymer A | 1.7 |
| Hexadecylalkyltrimethylammonium chloride | 3.0 |
| Moisture and minors | Balance to 100 |

The foregoing composition provides excellent cleaning and soil-release characteristics to hydrophobic fabrics which are washed in an aqueous solution of it.

Substantially similar results are achieved when the nonionic surface-active agent in the above composition is replaced by the condensation product of secondary $C_{11-15}$ alcohols with 9 moles of ethylene oxide; the condensation product of $C_{12-13}$ alcohols with 5 moles of ethylene oxide, wherein the mono- and nonethoxylated fractions are stripped away; the condensation product of $C_{14-15}$ alcohol with 4 moles of ethylene oxide; the condensation product of $C_{12}$ alcohol with 5 moles of ethylene oxide; the condensation product of $C_{10}$ alcohol with 4 moles of ethylene oxide; the condensation product of $C_{14}$ alcohol with 6 moles of ethylene oxide; the condensation product of $C_{12}$ alcohol with 4 moles of ethylene oxide; the condensation product of $C_{12-15}$ alcohol with 7 moles of ethylene oxide; the condensation product of $C_{12-13}$ alcohol with 3 moles of ethylene oxide, stripped so as to remove nonethoxylated and lower ethoxylate fractions; the condensation product of $C_{12-13}$ alcohol with 6.5 moles of ethylene oxide; the condensation product of secondary $C_{15}$ alcohol with 5 moles of ethylene oxide; or the condensation product of nonyl phenol with 9 moles of ethylene oxide.

EXAMPLE IV

A granular built laundry detergent, having the following formula, is prepared in a conventional manner:

| Component | Weight % |
|---|---|
| Sodium $C_{11.8}$ alkylbenzene sulfonate | 13.5 |
| Neodol 45-7 | 4.5 |
| Sodium pyrophosphate | 11.7 |
| Zeolite A | 15.0 |
| Sodium sulfate | 38.8 |
| Sodium silicate (2.4r) | 8.0 |
| Soil release polymer A | 1.7 |
| Tridecylalkylmethylammonium chloride | 0.3 |
| Moisture and minors | Balance to 100 |

The foregoing composition provides excellent cleaning and soil-release characteristics to hydrophobic fabrics which are washed in aqueous solutions of it.

EXAMPLE V

A liquid detergent composition, having the following formula, is formulated in a conventional manner:

| Component | Wt. % |
|---|---|
| Neodol 45-7 | 20 |
| $C_{16}N^{+}(EO)_9SO_4$* | 20 |
| Soil-release polymer A | 3 |
| Ditallowalkyldimethylammonium chloride | 0.5 |
| Water, alcohol and minors | Balance |

*an ethoxylated zwitterionic surfactant having the formula:

$$C_{16}H_{33}\overset{CH_3}{\underset{CH_3}{\overset{+}{N}}}-(C_2H_4O)_9-C_2H_4SO_4^-$$

The foregoing composition provides excellent cleaning and soil-release characteristics to hydrophobic fabrics which are washed in an aqueous solution of it.

EXAMPLE VI

A granular, built detergent composition, having the following formula, is formulated in a conventional manner.

| Component | Wt. % |
|---|---|
| $C_{16}N^{+}(EO)_9SO_4$ | 15 |
| Sodium tripolyphosphate | 35 |
| Sodium sulfate | 30 |
| Sodium silicate (3.2r) | 15 |
| Dicoconutalkyldimethylammonium chloride | 3 |
| Soil Release Polymer F | 1 |
| Water and minors | Balance |

The foregoing detergent composition when used in an aqueous solution provides excellent cleaning and soil-release characteristics to hydrophobic fabrics.

EXAMPLE VII

A liquid detergent composition, having the following formula, is made in a conventional manner:

| Component | Wt. % |
|---|---|
| Neodol 45-7 | 48 |
| Dicoconutalkyldimethylammonium bromide | 19 |
| Soil Release Polymer A | 2 |
| Water and minors | Balance to 100 |

The foregoing composition provides outstanding cleaning and soil-release characteristics to hydrophobic fabrics which are washed in an aqueous solution of it.

What is claimed is:

1. A laundry detergent composition comprising:

(a) from about 2% to about 95% by weight of a surfactant selected from the group consisting of water-soluble anionic, nonionic, zwitterionic and ampholytic surface-active agents and mixtures thereof; and (b) from about 0.15% to about 25% by weight of a soil release polymer comprising ethylene terephthalate and polyethylene oxide terephthalate at a molar ratio of ethylene terephthalate to polyethylene oxide terephthalate of from about 65:35 to about 80:20, said polyethylene oxide terephthalate containing polyethylene oxide linking units having a molecular weight of from about 1,000 to about 3,000, the molecular weight of said soil release polymer being in the range of from about 10,000 to about 50,000;

wherein at least 15% of said detergent composition is comprised of surfactant and detergency builder components, and wherein from about 0.05% to about 15% of said composition dissociates, in aqueous solution, yielding quaternary ammonium cations which include at least 1, and not more than 3, chains each containing from 8 to 24 carbon atoms.

2. A composition according to claim 1 wherein said quaternary ammonium cations which include at least one, and not more than three, chains each containing from 10 to 20 carbon atoms.

3. A composition according to claim 2 wherein the soil release polymer is present in an amount of from about 0.5% to about 15%.

4. A composition according to claim 3 wherein the quaternary ammonium cations include two or three chains each containing from 10 to 20 carbon atoms.

5. A composition according to claim 4 wherein the quaternary ammonium cations are ditallowalkyldimethylammonium cations.

6. A composition according to claim 4 wherein the quaternary ammonium cations are dicoconutalkyldimethylammonium cations.

7. A composition according to claim 4 wherein the quaternary ammonium cations are distearylalkyldimethylammonium cations.

8. A composition according to claim 4 wherein the quaternary ammonium cations are trioctylalkylmethylammonium cations.

9. A composition according to claim 4 wherein the quaternary ammonium cations are tridecylalkylmethylammonium cations.

10. A composition according to claim 2 wherein the quaternary ammonium cations have one chain containing from 10 to 20 carbon atoms.

11. A composition according to claim 10 wherein the quaternary ammonium cations are palmitylalkyltrimethylammonium cations.

12. A composition according to claim 10 wherein the quaternary ammonium cations are coconutalkyltrimethylammonium cations.

13. A granular detergent composition according to claim 3 wherein the surfactant is present in an amount of from about 10% to about 25%.

14. A liquid detergent composition according to claim 3 wherein the surfactant is present in an amount of from about 20% to about 60%.

15. A composition according to claim 3 wherein the surfactant is an anionic surface active agent selected from the group consisting of $C_{10}$ to $C_{16}$ alkylbenzene sulfonates, $C_{10}$ to $C_{16}$ alkyl sulfates, $C_{10}$ to $C_{16}$ ethoxylated alkyl sulfates, wherein the average degree of ethoxylation is between 1 and 6, and mixtures thereof.

16. A composition according to claim 15 wherein the surfactant is selected from the group consisting of magnesium neutralized anionic surfactants, calcium neutralized anionic surfactants, and mixtures thereof.

17. A composition according to claim 3 containing a mixture of anionic and nonionic surfactants, wherein said mixture contains at least 5%, by weight, of the nonionic surfactant.

18. A composition according to claim 17 wherein said nonionic surfactant comprises the condensation product of at least 5 moles of ethylene oxide with a $C_7$ to $C_{16}$ aliphatic alcohol.

19. A composition according to claim 3 containing a zwitterionic surfactant which is the derivative of an ethoxylated quaternary ammonium compound and which contains a sulfate or sulfonate anionic solubilizing group.

20. A composition according to claim 3 wherein said composition additionally contains up to about 50% of a detergency builder component.

21. A composition according to claim 3 is free of detergency builder components.

22. A composition according to claim 4 wherein the quaternary ammonium cations have the formula

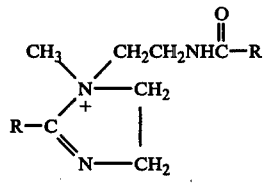

wherein each R is a $C_{10}$ to $C_{20}$ alkyl group.

23. A method for the removal of oily soils from polyester fibers comprising the washing of said fibers in an aqueous solution which contains from about 0.01% to about 0.3% of a detergent composition comprising:

(a) from about 2% to about 95% by weight of a surfactant selected from the group consisting of water-soluble anionic, nonionic, zwitterionic and ampholytic surface-active agents and mixtures thereof; and (b) from about 0.15% to about 25% by weight of a soil release polymer comprising ethylene terephthalate and polyethylene oxide terephthalate at a molar ratio of ethylene terephthalate to polyethylene oxide terephthalate of from about 65:35 to about 80:20, said polyethylene oxide terephthalate containing polyethylene oxide linking units having a molecular weight of from about 1,000 to about 3,000, the molecular weight of said soil release polymer being in the range of from about 10,000 to about 50,000;

wherein at least 15% of said detergent composition is comprised of surfactant and detergency builder components, and wherein from about 0.05% to about 15% of said composition dissociates, in aqueous solution, yielding quaternary ammonium cations which include at least one, and not more than three, chains each containing from 8 to 24 carbon atoms.

* * * * *